US008129904B2

(12) United States Patent
Ku

(10) Patent No.: US 8,129,904 B2
(45) Date of Patent: Mar. 6, 2012

(54) 3-D VIDEO CUBE

(76) Inventor: William Hsin-Min Ku, Princeton Junction, NJ (US)

( * ) Notice: Subject to any disclaimer, the term of this patent is extended or adjusted under 35 U.S.C. 154(b) by 583 days.

(21) Appl. No.: 12/264,325

(22) Filed: Nov. 4, 2008

(65) Prior Publication Data

US 2009/0128034 A1 May 21, 2009

Related U.S. Application Data

(60) Provisional application No. 60/986,316, filed on Nov. 8, 2007.

(51) Int. Cl.

| | |
|---|---|
| ***H01J 11/00*** | (2012.01) |
| ***H01J 17/00*** | (2006.01) |
| ***H01J 61/00*** | (2006.01) |
| ***H01J 17/20*** | (2012.01) |

(52) U.S. Cl. ..... 313/567; 313/358

(58) Field of Classification Search ..... 313/584, 313/567, 484, 483, 581, 358, 582, 583, 585, 313/586, 587

See application file for complete search history.

(56) References Cited

U.S. PATENT DOCUMENTS

| | | | | |
|---|---|---|---|---|
| 2,762,031 | A * | 9/1956 | Fryklund | 367/107 |
| 5,962,975 | A * | 10/1999 | Lepselter | 313/586 |
| 6,052,100 | A * | 4/2000 | Soltan et al. | 345/6 |
| 6,479,929 | B1 * | 11/2002 | Knabenbauer | 313/484 |
| 6,827,623 | B2 * | 12/2004 | Nakatake et al. | 445/25 |
| 2002/0190921 | A1 * | 12/2002 | Hilton | 345/6 |
| 2010/0321478 | A1 * | 12/2010 | Sliwa et al. | 348/51 |

* cited by examiner

*Primary Examiner* — Mariceli Santiago
*Assistant Examiner* — Glenn Zimmerman

(57) ABSTRACT

The present invention is a novel, high resolution, color, three-dimensional (3-D) volumetric display system for dynamic images—the video cube. The video cube consists of an air-tight glass cube filled with a gas mixture and multiple planes of thin wires arranged in alternating orthogonal layers. These wires may be set at voltage potentials capable of producing a glow discharge at the intersection of pairs of wires. Using a computer capable of storing dynamic image data and electronic controllers capable of energizing pairs of wires appropriately at the proper time 3-D dynamic images may be formed from multiple glows between excited wire pairs. The video cube may be used to display complex real-time information from computers and other digital processors with high accuracy for unlimited number of simultaneous unaided observers.

10 Claims, 6 Drawing Sheets

3-D VIDEO CUBE

BACKGROUND OF THE INVENTION

As the amount of information generated and stored in digital form has exploded over the last few years, demand for improved systems to display the information processed by new multimedia digital devices has become more critical. The most efficient way for humans to absorb vast amounts of information quickly is visual. 2-D displays have improved greatly in terms of price and performance over the last few years but in many applications the inherent 4-D nature of most data is shortchanged by the lack of a real third spatial dimension in the display device. The vast majority of 3-D devices require visual aids for the observer or complex mechanical motion in the display, and lack true 360* viewing capability for the audience. Several static, auto-stereoscopic volumetric display devices have been proposed and built over the last few decades but all of them have certain limitations in terms of spatial resolution, temporal resolution, viewing angle, color fidelity, ability to deal with occlusion and opacity, cost, and complexity of construction and operation (see Volumetric Display devices in Wikipedia).

The ability to display 3-D information accurately is becoming increasingly crucial in areas such as defense applications where the battlefield of the future is no longer bound by the 2-D limits of the surface of the earth but the 3-D of space. For example, pilots in (or remotely controlling) sophisticated aircrafts need to quickly assimilate the vast amount of data from advanced electronic monitor and command systems. The need for improved situation awareness encompasses informing the pilot of other aircrafts, ground threats and terrain in his area and their spatial relationship to his aircraft. A 3-D display capable of rapidly updating the data generated by computers and other electronic 3-D monitors would be ideally suited for this purpose. This technology could also provide realistic 3-D imagery of the cockpit's view for more effective laboratory flight simulators. A 3-D display could also support ground based applications including mobile and laboratory flight simulators, rapid cockpit prototyping, pilot-aiding artificial-intelligence knowledgebase development, unmanned aerial vehicles operations, and avionics development workstations.

Commercial demand for 3-D display capability is also expected to increase in the areas of radar and navigational displays, complex outputs from scientific and engineering simulations, medical and biotech imaging, robotic command, control and monitoring, entertainment and artistic applications, and numerous other needs.

We propose a novel 3-D volumetric display system called the video cube which is capable of 0.4-mm or better resolution over a very large format (FIG. 1). The video cube consists of a gas-tight box filled with low pressure gas and a fine, 3-D grid of wires. The wires are energized by an array of medium voltage power sources and controlled by a 64-bit microprocessor with 128 GB of display buffer memory. This system permits true 3-D visualization from all angles and can be rapidly updated to display continuous moving images. The cost of the projected prototype system is high, but continued reduction in semiconductor component and plasma display technology costs should bring the cost of the video cube within reach of the commercial market by 2010.

DESCRIPTION OF THE INVENTION

C.1 Basic Concept

The video cube operates on the principle of photon emission from a moderate voltage discharge in a low pressure gas.

It employs certain technologies already developed for particle physics detectors and gas discharge (plasma) displays.

The prototype video cube consists of a 225×225×225 mm air-tight glass cube (7 mm wall) filled with 600 Torr of Ne—Ar (0.1%) gas. Inside, an open cube structure, consisting of 4 inner walls made from 3 mm thick glass slabs with 100 μm diameter holes, spaced 400×800 μm apart is used as a frame to support a fine grid of wires. Each plane of wires consists of 100 μm diameter glass-coated tungsten wires, spaced 400 μm apart (FIG. 2). Adjacent wire planes are strung perpendicular to one another. These wires are uniformly tensioned (2 N) and then epoxied to the glass frame.

Transparent external wire leads attached through the bottom and back of the cube may be used to supply power and signal to the inner wires. If a particular $x_i$ wire is energized to +V in the $z_i$ plane (anode), and a particular $y_i$ wire is energized to −V in the $z_{i+1}$ plane (cathode) the large 2V potential drop across the 400 μm gap will create a glowing plasma cloud in the gas near the wires if a few seed electrons and ions are provided by cosmic rays, a nearby radioactive source, or a priming current.

C.2 Principle of Operation

The current will rise rapidly as a function of increasing voltage until the voltage reaches a plateau value known as the ignition voltage, $V_i$ (FIG. 3). The height and the width of the plateau in the Townsend discharge region may be decreased by stepping up the incident radiation or injecting electrons from another source—a process known as "priming". As the number of electrons increases, the current increases, and the space charge builds up near the cathode, the interelectrode voltage will decrease (B—C). The transition or subnormal glow state continues until a value of current density at the cathode which produces the most efficient ionization of gas molecules is achieved. The gas discharge will glow in the visible producing a bright point near the cathode—behavior characteristic of the normal glow region. For subsequent increases in current, the voltage increases slowly (maintaining voltage $V_m$), the current density remains constant, and the glow expands along the cathode wire. As soon as the discharge covers the entire cathode (abnormal glow region), the ionization efficiency begins to drop, and the voltage rises more rapidly with current. At very high currents the power dissipation and field become so great, and the temperature so high that thermionic emission and field emission become the dominant processes and an arc develops. When the potential drops below some extinction voltage $V_e$, the glow will fade. To prevent the glow from spreading too far along the wires and the wires from sustaining too much sputtering damage, a series resistor or capacitor is used to limit the current (below D in FIG. 3) and the power.

A detailed examination of the glow discharge in the normal region of operation shows that there are two luminous regions separated from each other by a dark region called the Faraday dark space: the negative glow near the cathode but separated from it by the cathode dark space, and the positive column near the anode but separated from it by the anode dark space (FIG. 4). As the interelectrode distance is reduced, the positive column reduces in length and eventually merges into the negative glow which generally dominates the emission. In this situation virtually all the potential drop occurs across the cathode dark space, and the electric field weakens through the negative glow region and falls to near zero outside this region. The ion and electron space charge density is also highest near the cathode.

The physics of the gas discharge reaction is quite complex. Important processes include excitation, metastable generation, ionization, and Penning ionization of atoms in the gas, and the ejection of electrons from the cathode surface by ions, metastable atoms, or photons. For illustrative purposes, consider a voltage applied across electrodes in a Ne—Ar gas mixture. Free electrons in the gas are accelerated by the electric field making many collisions with neon atoms. Since the neon atom does not have any allowable energy levels between 0 and 16.6 eV, most of these collisions will be elastic with no energy transfer. After many collisions, the electric field will have accelerated some of these electrons to energies greater than 16.6 eV which are then capable of exciting electrons in the neon atoms to higher energy levels. Electrons in these higher energy states typically have lifetimes of ~$10^{-8}$ sec and radiate infrared, visible, and UV photons in the transitions back to the ground state (FIG. 5).

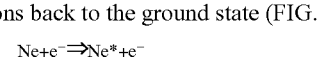

$$Ne+e^- \Rightarrow Ne^*+e^-$$

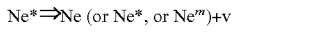

$$Ne^* \Rightarrow Ne \text{ (or } Ne^*\text{, or } Ne^m)+v$$

The dominant visible transitions are 2p electrons to 2s levels yielding photons with wavelengths near 600 nm (585 nm is brightest wavelength and correspond to the familiar orange neon glow). Electrons in the $2s_2$ and $2s_4$ states will relax quickly to the ground state with the emission of ~74 nm UV photons. The brightness of the gas discharge depends on the power input and is typically of the order of 0.1-0.5 lm/W for neon based mixtures.

Electrons in ¾ of the 2s states may not relax to the ground state with the emission of a photon and are therefore metastable, $Ne^m$. Metastable atoms may remain as such for several microseconds until they are de-excited by a reaction with some other body. If they de-excite by collision with the walls, their energy is generally lost from the avalanche. They may also de-excite by collision with atoms which have ionization potentials lower than 16.6 eV. Argon (15.8 eV), krypton (14.0 eV) and xenon (12.1 eV) all satisfy this criterion. For example:

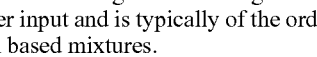

$$Ne^m+A \Rightarrow A^++e^-+Ne$$

This reaction has a high probability, ~$3\times10^3$ times the probability of ionization in pure neon by the collision of metastables, and thus yield far more electrons and ions. This reaction is called Penning ionization and such multicomponent gases are called Penning mixtures.

When the free electrons gain more than 21.6 eV of energy they may ionize the neon atoms directly.

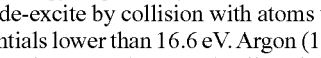

$$Ne+e^- \Rightarrow Ne^++2e^-$$

The ions drift slowly toward the cathode and the electrons drift quickly toward the anode gaining more energy. The electrons can cause additional ionization resulting in an avalanche. As the avalanche progresses toward the anode, the number of ionizations increases exponentially with a multiplication factor (M), of several hundred possible.

$$M=\gamma e^{\alpha E/P}$$

A number of reactions also occur at the surface of the cathode. Electron ejection from the cathode can be stimulated by collisions with positive ions, metastables, and photons. These electrons are critical to the discharge process since they initiate the gas reactions. The most important electron ejection mechanism is collisions with neon and argon ions which carry 21.6 and 15.8 eV of energy, respectively. The energy is more than enough to allow an electron to escape the work function potential of the cathode surface which is generally in the 3-20 eV range. Thus an ion collision has a high probability of ejecting an electron which coupled with the fact that every electron created in the avalanche generate an ion which drift to the cathode, constitute the main electron source for the avalanche. Photoemission may generate additional electrons since the UV photons have more than enough energy to knock out electrons. However, since these photons are emitted randomly, only a small fraction will intercept the cathode. Metastables can also eject electrons with a high probability but since they diffuse much more slowly and randomly, only a small fraction will impact the cathode.

Both the ignition and the maintaining potentials depend on the ionization of the gas and secondary effects at the cathode. It has been found by experiment that the ignition voltage depends on the product of the pressure P, and the interelectrode distance d (Murase et al. 1976), $$V_i=A(Pd)/[\log\{B(Pd)/\log(1+1/\gamma)\}],$$

where A and B are constants determined by the gas mixture, and γ is the secondary emission coefficient of the overcoat material. Curves of $V_i$ against Pd commonly show a minimum value (FIG. 6). For example, Ne—Ar (0.1%) shows a broad minimum ignition voltage of ~200 V near 30 Torr-cm using iron electrodes. For a planar electrode geometry this suggests that a pressure of 600 Torr should be used with an anode-to-cathode separation distance of 0.4 mm; for a wire geometry, the ignition voltage could be substantially lower since a low voltage can yield a very high field near a wire.

The perceived brightness of the display also depends on the dynamic behavior of the discharge since pulsed voltages are applied to the wires. The time for the avalanche to grow depends on the sum of a statistical and a formative delay time. The statistical delay time is due to the requirement for at least one electron to initiate the avalanche. In the absence of priming agents, an energetic cosmic ray may trigger the breakdown but this can take several minutes. This delay time may be reduced by increasing the priming current via radioactive source (eg. $^{85}Kr$), pilot-cell, or self-priming techniques. Once the growth of the discharge has matured beyond the statistical regime, one must still wait for a finite time before the discharge reaches the desired current level and brightness. The current rise is an exponential function of time and the delay time is a strong function of the ignition voltage. The total delay time may range from 0.1 to 100 μs. The decay of the gas discharge after the applied voltage falls below $V_e$ is also important. The visible light or the afterglow decays within a few microseconds, but many of the other particles in the discharge lose energy much more slowly and determine the priming conditions for subsequent discharges. Metastables can be de-excited by the Penning process within a few microseconds. Ions and electrons in the weak field of a plasma will diffuse slowly to the electrodes and can take more than 5-50 μs to lose their energy. Since one electron can initiate a discharge, the impact of the residual charges on subsequent discharges can last for several milliseconds. This recovery time depends on the discharge current, the residual field strength, P/d, and the gas composition.

C.3 Electrical Design

The electrical system must provide the voltage to trigger the discharge, a viable scheme to limit the discharge current, the memory to refresh the display (although some modes of operation may not require this), and the microprocessor to control the wire addressing and interfacing to the information source. The electrical system contains the most expensive components of the proposed video cube design and may determine the future commercial viability of the device.

The basic requirement to limit the current in each discharge to avoid the negative glow from spreading along the cathode and significant damage to the electrode can be accomplished via two basic techniques: resistors and capacitors which define respectively, the dc and ac types of plasma displays (FIG. 7). Resistors (~100 kΩ) can be attached to each node of the matrix to limit the dc current flow. However, this technique is extremely expensive and awkward to implement. Alternatively, one resistor and voltage source may be attached to a line of nodes. This scheme requires that the voltage be pulsed and scanned. Pulse rise (~2 μs) and self priming time (~2 ms) considerations limit this technique to displays with <500 lines per axis. In addition, duty cycle and brightness considerations generally limit its practical use to <200 lines per axis.

AC displays use an internal dielectric layer to limit the current. The dielectric glass layer forms a small capacitor that is in series with every gas discharge. No external resistor is needed because the buildup of voltage across the dielectric limits the current. Because the dielectric glass is an excellent insulator, no dc current can flow, so that an ac voltage must be applied to maintain a discharge. The ac voltage and negative glow alternates between electrodes on each half cycle and sputtering damage to the cathode is less than for dc displays. Due to its memory capability (see below), the ac display does not need to be refreshed and for large formats is generally much brighter than dc displays.

When the total voltage applied across two wires at a node, exceeds the ignition voltage, a discharge current will begin to flow. This current will deposit charge on the glass dielectric walls which lowers the magnitude of the voltage across the gap sufficiently to extinguish the discharge. This charge on the wall is called wall charge and corresponds to a voltage component across the gas called the wall voltage $V_w$. The combination of the wall voltage and the sustain voltage of the source yields the net voltage across the gap called the cell voltage.

$$V_c = V_s + V_w$$

If a sustain voltage waveform of the proper amplitude and shape is applied to the wires, they will exhibit bi-stable memory. Typical sustain pulses have square symmetrical return-to-zero shapes, and widths of ~10 μs at a frequency of 50 kHz (FIG. 7). The zero-to-peak pulse amplitude is ~100 volts. When a cell is on, it discharges and emits light whenever the sustain waveform first achieves a positive or a negative peak. When the wall voltage increases sufficiently that the net voltage drops below the extinction voltage, the discharge will die after a few microseconds. Now the residual wall voltage is of the opposite polarity so that when the sustain voltage is reversed, the high magnitude of $V_c$ will again ignite a discharge. In the off state, there are no discharges and the wall voltage remains at zero. In this case $V_c = V_s$ with $V_s$ set sufficiently below the ignition voltage that no discharges will occur. Thus a node can be in either the discharging or non-discharging state with the same sustain voltage applied.

To excite the proper node or voxel in the video cube, one must introduce the appropriate address pulses needed to change the wall voltage and state of the node (FIG. 8). A separate voltage source is used to generate a write pulse of sufficient amplitude to initiate a discharge. This discharge will charge the walls of the wire and change $V_w$ from zero to the on-state level. A typical width of the write pulse is ~5 μs. Similarly, an erase pulse may be sent to turn off the node. Like the write pulse, the amplitude and width of the erase pulse is selected so that only half the amount of wall voltage change occurs compared to a normal sustain discharge. The net write or erase voltage is the sum of voltages supplied by 2 coincident voltage pulses applied to the appropriate x, and y wire planes each of which carries half the voltage. A write/erase enable signal is used to cyclically select the appropriate z plane through a diode-resistor network 512 times every 16.6 ms permitting the x-y information to be updated for 32 μs each cycle.

The number of voltage drivers needed for a full matrix implementation of the $512^3$ 3-D display is 512×3=1536. A separate driver is used to supply address voltage for each x and y wire plane, and the 512 sustain voltages on each z plane. Each address driver need to supply ~50 volts. Integrated circuit address driver packages can be obtained from semiconductor manufacturers such as Texas Instruments (TI). TI has a 40-pin dual-in-line package (SN 75500/1) capable of driving 32 display lines with up to 100 V pulses at currents up to 20 mA. CMOS shift registers and logic gates are included in each device to help interface the device to the controlling microprocessor. The video cube requires 48 of these chips. The sustain-voltage generator must be robust enough to rapidly charge and discharge the large capacitance of the wire planes and power the simultaneous discharging of a large number of nodes.

A 64-bit microprocessor (Intel Itanium 2) can be used to control the address voltage drivers. A 128 GB flash buffer memory can be used to store several minutes' worth of $512^3 = 1.3\times10^8$ voxels of dynamic volumetric display.

C.4 Mechanical Design

We have considered two basic structural designs for the video cube corresponding to mechanically or electrically multiplexing a plane of information: a moving plane of wires, and a full cubic lattice of wires. A set of 3 20×20 cm plane of 512×512 wires set orthogonal to one another can be rotated fast enough (~60 Hz—relying on the eye's persistence of vision) to produce flicker-free 3-D images (FIG. 9). This would be similar to other swept-surface volumetric displays currently proposed and/or built. A microprocessor can be used to address the proper nodes in phase with the rotation. This alternative has the attraction of a simple structure and lower material cost. Connected to a 64-bit microprocessor with 128 GB of memory, the proper software/firmware instructions to address the 3-D image can be coded to synchronize the data with the rotation. Displaying the rotating plane of information to yield 3-D images can be thought of as the reverse of acquiring 3-D information with CAT planar scans in medical applications. Like other swept-plane volumetric displays it would have size, occlusion, and temporal resolution issues which can be better addressed with a static volumetric display.

Our preferred embodiment is a static volumetric display employing a full 3-D matrix of wires. Such a lattice structure should provide brighter, truer, and more stable dynamic images. The stationary structure should be more reliable, consume less power, and require less computing power and time to encode and address the voxels. This scheme does suffer from the disadvantage of requiring 50% more driver circuits to operate.

The prototype 3-D video cube has a simple 220×220×220×6 mm outer glass (soda lime silicate) vacuum-tight envelope. The internal structure is an open cube consisting of 4, 3-mm thick glass slabs fritted together. 100 μm diameter holes, spaced 0.4 mm×0.8 mm apart, are drilled into each slab before joining (FIG. 10). Each of the 512 planes of wires consist of 80 μm diameter tungsten wires coated with 10 μm of solder glass dielectric material. 200 nm of MgO is used to overcoat the dielectric glass. The MgO has a high secondary emission coefficient which remains very stable with time. The wires are spaced 400 μm apart and attached to the glass frame with glass-to-metal seals. Adjacent wire planes (labeled x and y) are oriented orthogonal to one another and separated by 400 μm. This choice of dimensions leaves >99% of the volume transparent. A different choice of electrode geometry might be better to minimize the amount of backside emission from a solid object (the hidden surface or occlusion problem—analogous to the hidden line problem for 2-D display of 3-D objects which is solved with proper coding), but could also entail a tradeoff between mechanical stability and accuracy, gas mixture, and transparency. 512 wires with the same x coordinate are wired together, as are 512 wires with the same y coordinate, each to one of 1024 voltage driver circuit outside the glass envelope through the bottom side of the cube. Every wire on each z plane is wired to one of 512 diode-resistor switches outside the cube through the bottom side. After assembly and before sealing, the entire structure is evacuated and outgassed thoroughly under hard vacuum to reduce contaminants.

While the mechanical structure of the video cube is somewhat unusual, we are confident that it will work. Large-scale open-celled structures (Nolan, 1969) as well as wire electrodes have been used successfully in previous gas discharge displays. Similar wire plane structures have been built for photon and particle detection in square meter sizes that have met high alignment requirements and withstood severe environmental stresses.

C.5 Summary: Unique Aspects and Other Enhancements

The video cube possesses many of the same advantages that 2-D plasma displays have over other display systems: very strong electrical nonlinearity, discharge switching, intrinsic memory, long lifetime, good brightness and luminous efficiency, rugged and simple structure, high resolution and fidelity, large formats, and tolerance for high temperatures and stray magnetic fields. While the proposed video cube is quite similar to a 2-D gas-discharge display, the use of thin conductive wires in a 3-D grid rather than conductive strips on a bulky substrate permit a more compact and higher resolution true 3-D display with lower voltages and higher pressures. Construction and mechanical alignment should be no more difficult than conventional plasma displays. Most importantly, the video cube offers a unique and effective way to present dynamic, 3-D image information.

Future enhancements include improving the color fidelity and occlusion/opacity capability of the basic video cube. One design is use a close packed cubic array of coated gas-filled glass beads (FIG. 11). A prototype geometry involves 400 μm diameter beads filled with 3 different mixtures of noble gases (e.g. Ne—Ar, Ne—Kr, and Ne—Xe) which glow at different colors. Adjusting the voltages at crossed wire points would excite different voxels to emit different colors which can be mixed to produce a spectrum of colors. A thin coating of an electrochromic (or liquid crystal material) on each glass bead surface can be electrically controlled to make the voxel more or less transparent. Inner glass beads corresponding to non-visible voxels can be made opaque with proper voltage-current setting between two crossed wires controlling that voxel. This will provide true color solid imaging permitting the video cube to replace conventional display systems in a wide range of applications.

Figure 1:
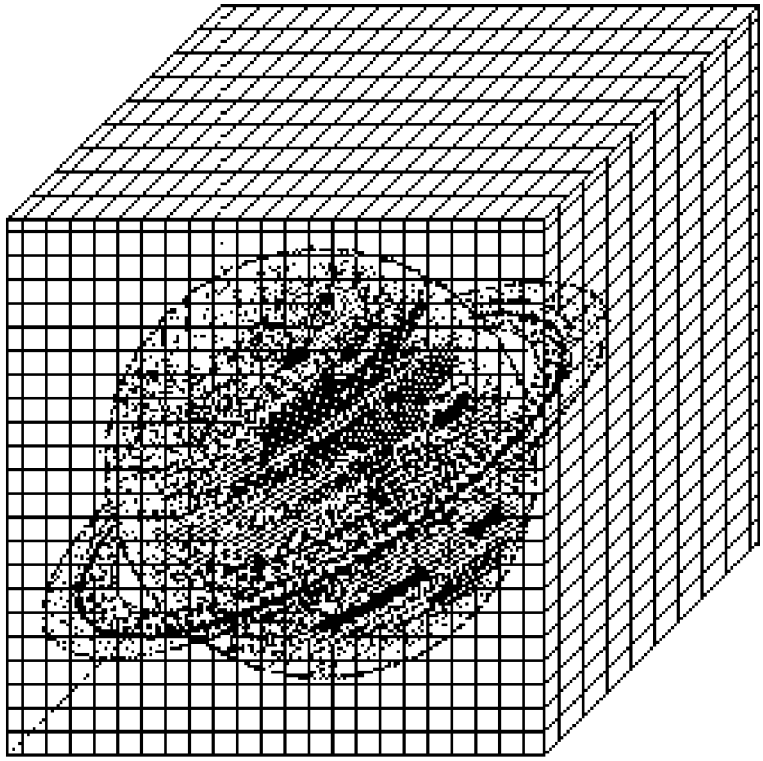
FIG. 1. Schematic of the Video Cube comprised of a stack of alternating orthogonal thin wire planes enclosed in transparent air-tight glass cube containing a noble gas mixture.
Figure 2:
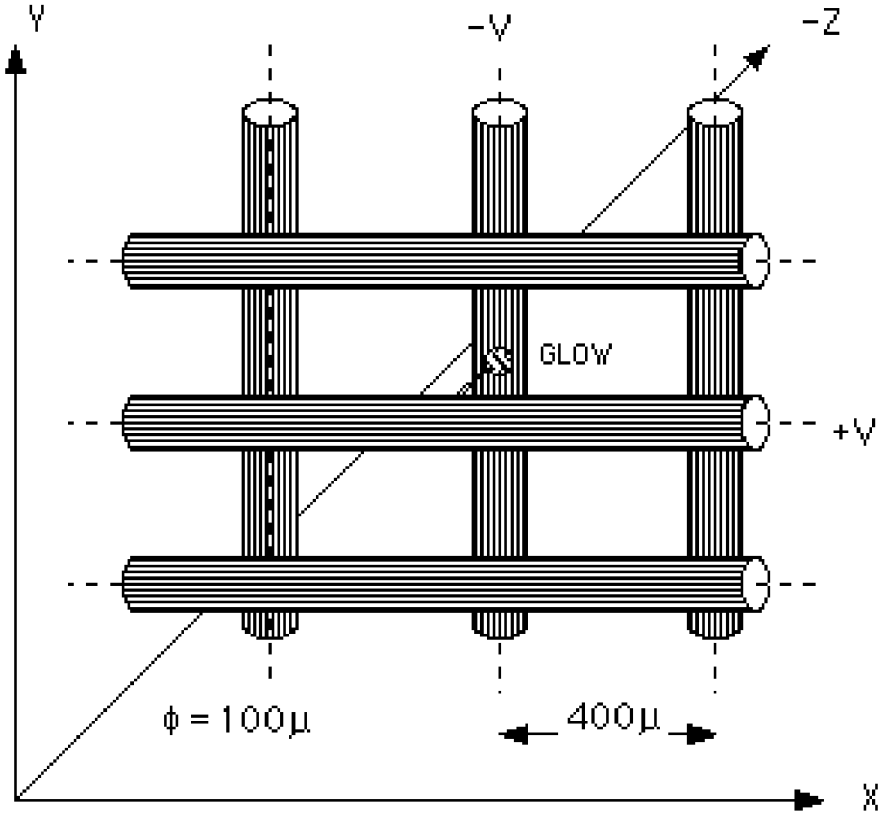
FIG. 2. Schematic of the wire grid geometry with one set of tungsten wires running along the x-axis and an adjacent set of wires running along the y-axis. When a pair of wires are energized +V in the x-direction and −V in the y-direction, the potential difference will cause a gas discharge glow to appear between the wires.
Figure 3:
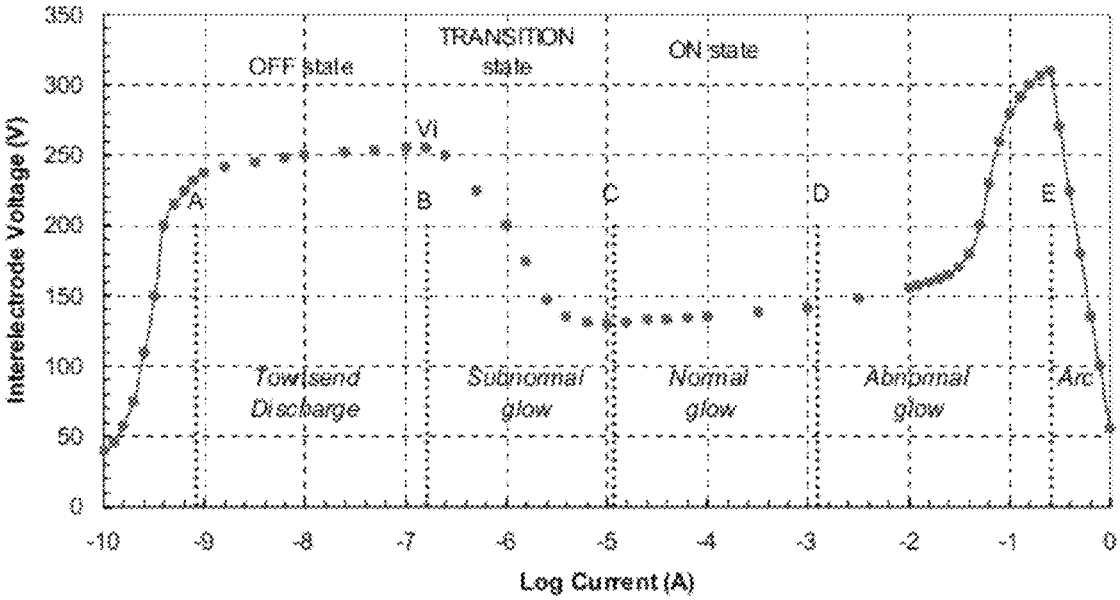
FIG. 3. Graph of the current-voltage characteristic for a typical gas discharge.
Figure 4:
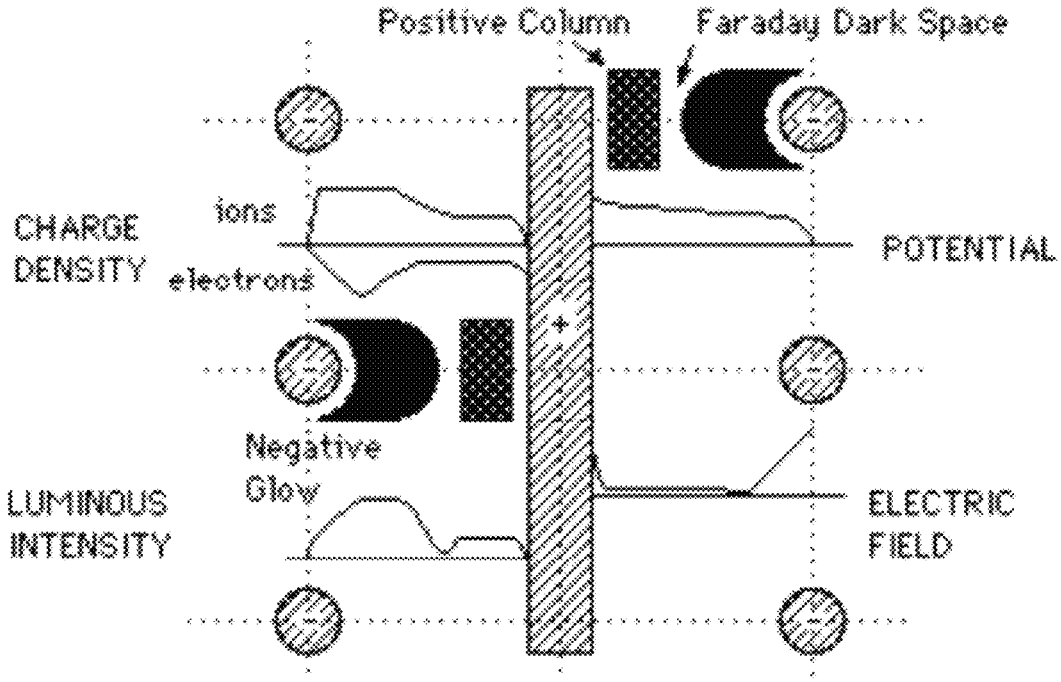
FIG. 4. Schematic of the potential, field and charge density distribution near the glow regions. In our compact wire geometry the positive column is actually not separated from the negative glow.
Figure 5:
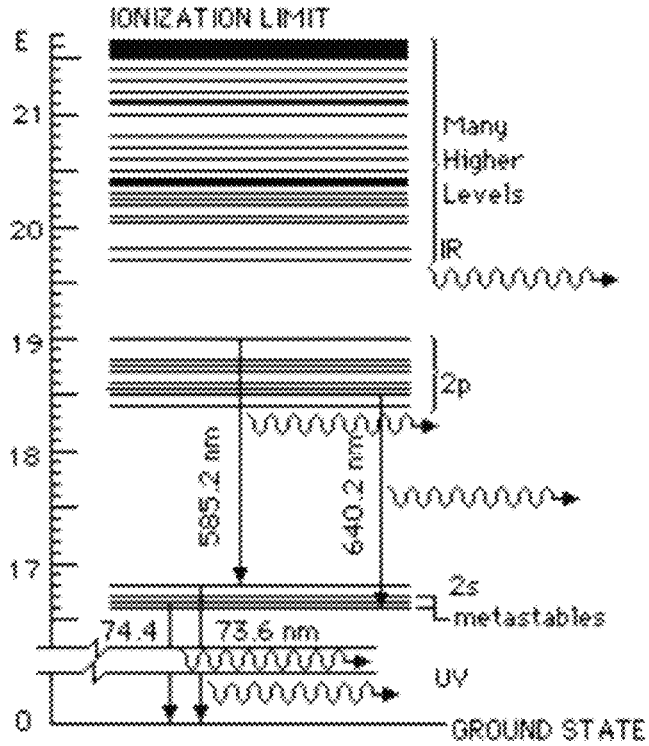
FIG. 5. Energy level diagram for neon showing some of the major transitions.
Figure 6:
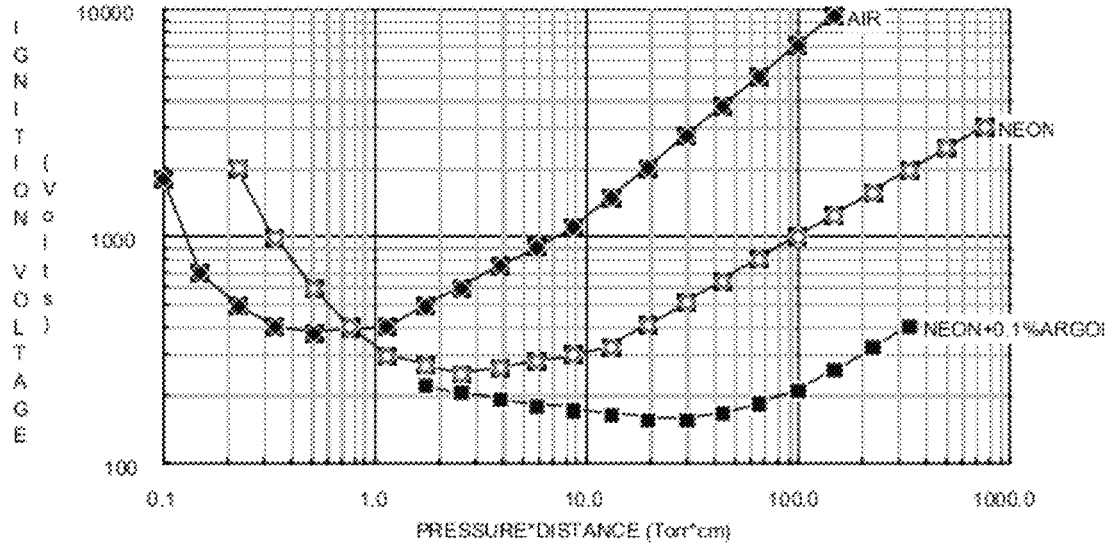
FIG. 6. Paschen curve showing the dependence of the breakdown/ignition voltage on the product of the gas pressure and the cathode-anode separation distance for several gases.
Figure 7:
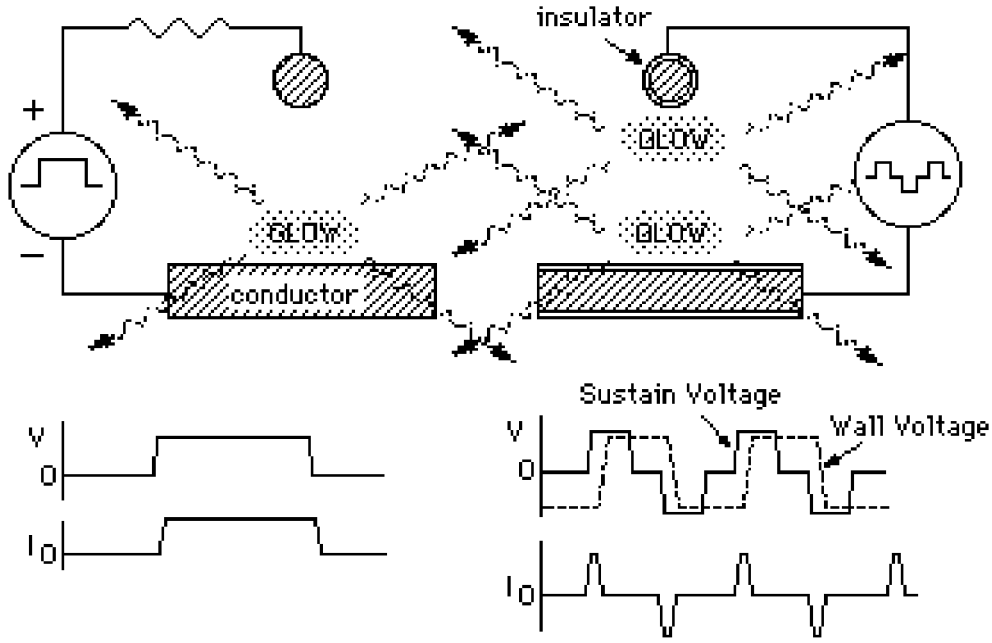
FIG. 7. Schematic of the dc resistive and ac capacitive current limiting schemes FIG. 8. Schematic of the timing logic used to write and erase a cell. Voltage pulses for each of the x, y, and z wire planes are shown for a typical active and inactive cell.
Figure 8:
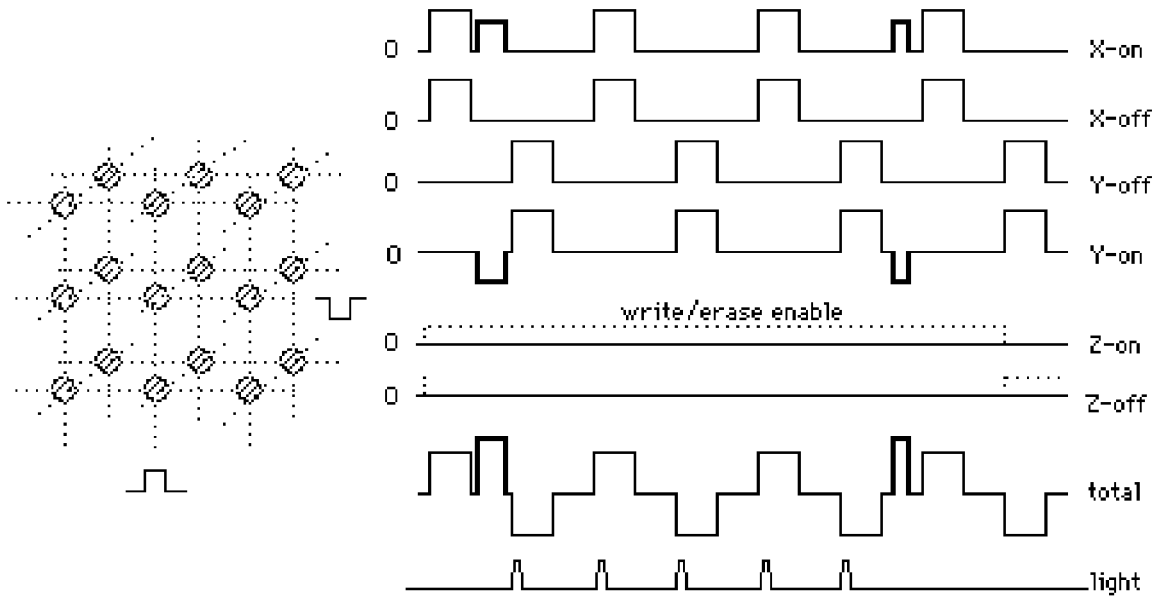
Figure 9:
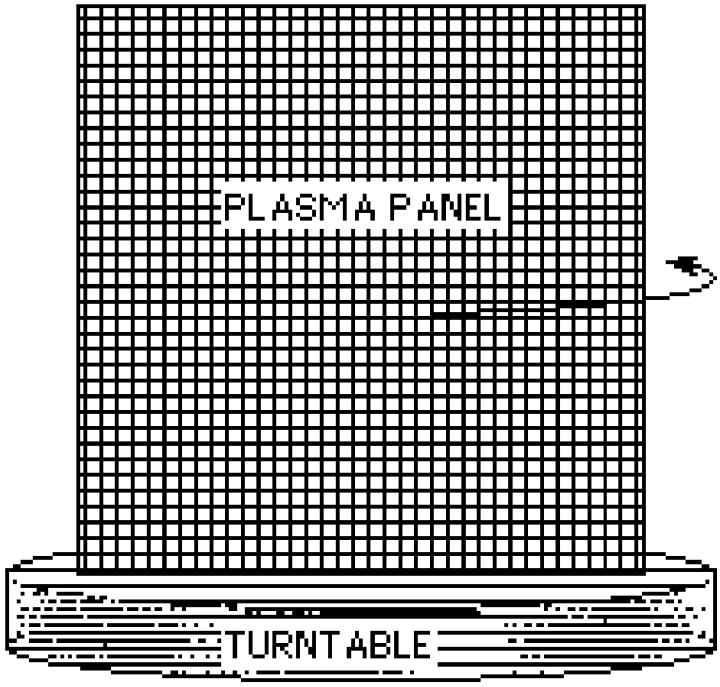
FIG. 9. A schematic of the rotating plasma panel that could produce a swept-plane volumetric 3-D display.
Figure 10:
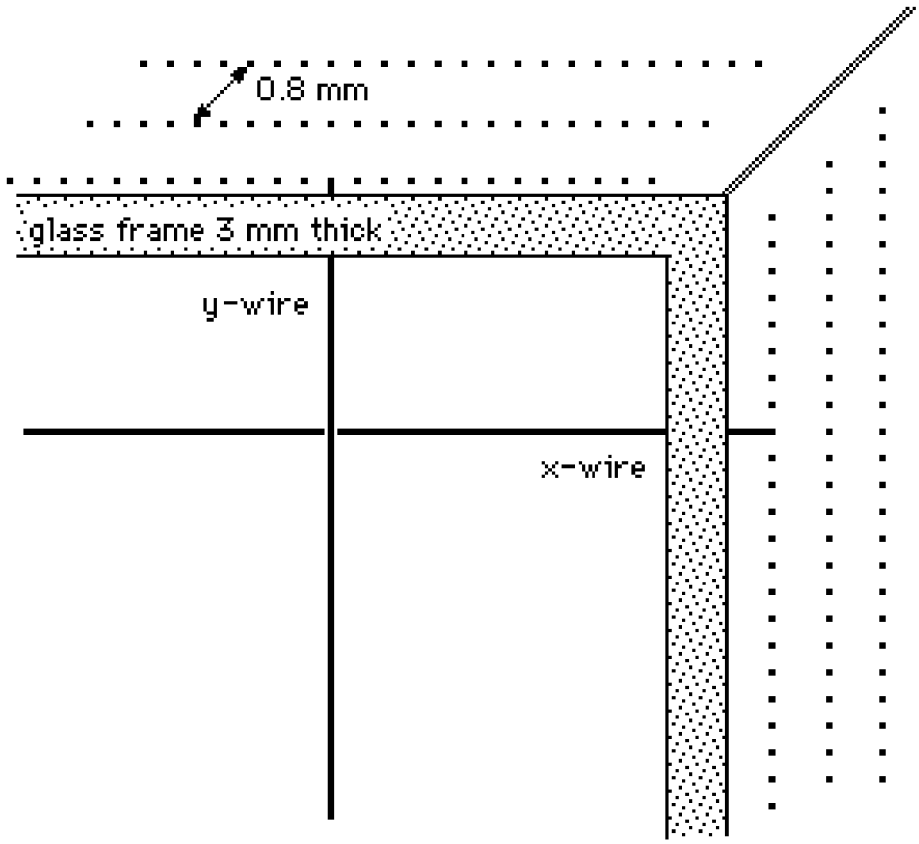
FIG. 10 A magnified view of a corner of the video cube shown in FIG. 1 detailing the wire glass frame structure inside the cubicle glass enclosure.
Figure 11:
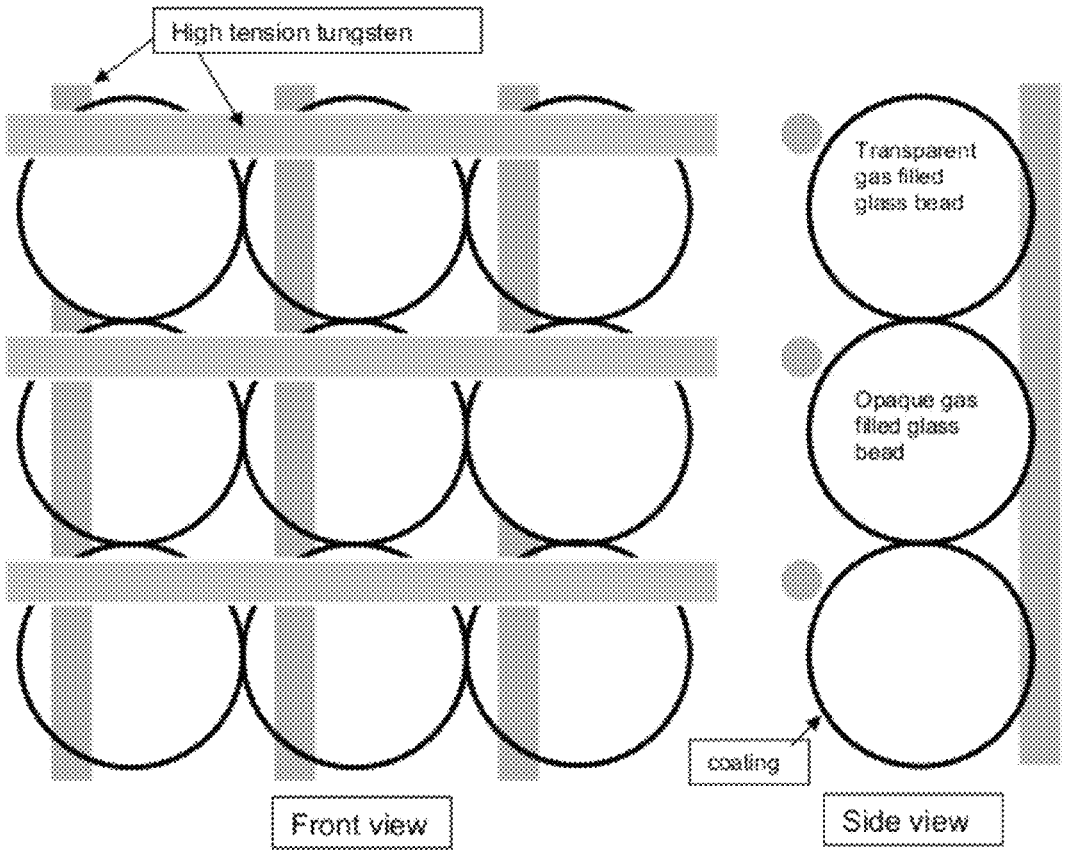
FIG. 11 A detailed schematic of an alternate embodiment of the video cube to provide improved color fidelity and occlusion/opacity capabilities. The same array of orthogonal planes of wires as described in FIG. 1 is filled with a closed packed cubic array of coated gas-filled glass beads. Each of 3 sets of beads contains a different mixture of noble gases with different glow discharge colors. Each glass bead is coated with an electrochromic or liquid crystal film to control transparency.

I claim:

1. A volumetric display comprising a glass cube filled with gas and multiple planes of thin wires arranged in alternating orthogonal layers; wherein the wires may be set at voltage potentials for producing a glow discharge at the intersection of pairs of the wires; and wherein using a computer for storing 4-D image data and electronic controllers for coordinated simultaneous excitation of multiple pairs of the wires appropriately at the proper time 3-D dynamic images may be formed from the multiple glows between the wire pairs that are energized.

2. The volumetric display of claim 1 wherein the enclosure of the glass cube is gas-tight and comprises of four fully transparent glass sides affording 360° view of the dynamic 3-D image inside, a transparent glass side on top, and one bottom glass side which has wire leads feeding through but is otherwise transparent.

3. The volumetric display of claim 1 wherein the glow discharges occur at extremely precise locations as determined by the spacing and size of the thin wires strung under tension through holes in glass frames inside the glass cube; and wherein the thin wires are metal and have a glass coating.

4. The volumetric display of claim 1 wherein colors are determined by appropriate mixture of gases and excitation voltages applied to the wires inside the cube.

5. The volumetric display of claim 1 wherein brightness is determined by appropriate mixture and pressure of gases as well as by the magnitude and timing of the applied voltages and current limiters placed on each wire.

6. A volumetric display comprising a glass cube filled with multiple planes of thin wires arranged in alternating orthogonal layers and a close packed cubic array of coated gas-filled, glass beads; wherein the wires may be set at a wide range of voltage potentials; and wherein using a computer for storing 4-D image data and electronic controllers for coordinated simultaneous excitation of multiple pairs of the wires appropriately at the proper time, realistic (in form, color and opacity) 3-D dynamic images may be formed from the glowing gas in the glass beads set between the wire pairs that are energized.

7. The volumetric display of claim 6 wherein the enclosure of the glass cube is gas-tight and comprises of four fully transparent glass sides affording 360° view of the dynamic 3-D image inside, a transparent glass side on top, and one bottom glass side which has wire leads feeding through but is otherwise transparent.

8. The volumetric display of claim 6 wherein the glow discharges occur at extremely precise locations as determined by the spacing and size of the thin wires strung under tension through holes in glass frames inside the glass cube, and wherein the thin wires are metal and have a glass coating.

9. The volumetric display of claim 6 wherein the enclosure of the glass cube includes within a plurality of the glass beads; and wherein each glass bead's transparency is determined by an electrical signal applied by two orthogonal wire pairs of the multiple planes of thin wires to a coating which may be an electrochromic material.

10. The volumetric display of claim 6 wherein the enclosure of the glass cube includes within a plurality of the glass beads; and wherein each glass bead contains one of three different gas mixtures energized by one adjacent orthogonal wire pair of the multiple planes of thin wires to emit one of three different colored glows with appropriate intensity which together as a triplet determine the color and brightness of a full voxel.

* * * * *